US006915597B2

(12) United States Patent
Jungkind

(10) Patent No.: US 6,915,597 B2
(45) Date of Patent: Jul. 12, 2005

(54) SPORTS SHOE

(75) Inventor: Roland Jungkind, Garmisch-Partenkirchen (DE)

(73) Assignee: Puma Aktiengesellschaft Rudolf Dassler Sport, Herzogenaurach (DE)

( * ) Notice: Subject to any disclaimer, the term of this patent is extended or adjusted under 35 U.S.C. 154(b) by 49 days.

(21) Appl. No.: 10/415,278

(22) PCT Filed: Nov. 8, 2001

(86) PCT No.: PCT/DE01/04172

§ 371 (c)(1),
(2), (4) Date: Apr. 28, 2003

(87) PCT Pub. No.: WO02/37996

PCT Pub. Date: May 16, 2002

(65) Prior Publication Data

US 2004/0025378 A1 Feb. 12, 2004

(30) Foreign Application Priority Data

Nov. 10, 2000 (DE) ..... 100 55 771

(51) Int. Cl.[7] ..... A43B 5/00; A43C 15/00
(52) U.S. Cl. ..... 36/134; 36/67 D; 36/67 R
(58) Field of Search ..... 36/67 D, 67 R, 36/134, 15, 42

(56) References Cited

U.S. PATENT DOCUMENTS

| | | | | | |
|---|---|---|---|---|---|
| 1,559,086 | A | * | 10/1925 | Golden | 36/59 R |
| 2,523,652 | A | * | 9/1950 | Dowd et al. | 36/59 R |
| 3,082,549 | A | | 3/1963 | Dolceamore | |
| 3,127,687 | A | * | 4/1964 | Hollister et al. | 36/114 |
| 3,352,034 | A | * | 11/1967 | Braun | 36/67 D |
| 4,858,343 | A | * | 8/1989 | Flemming | 36/128 |
| 5,505,012 | A | | 4/1996 | Walker et al. | |
| 6,301,806 | B1 | * | 10/2001 | Heller | 36/134 |
| 2002/0100190 | A1 | * | 8/2002 | Pellerin | 36/126 |

FOREIGN PATENT DOCUMENTS

| | | |
|---|---|---|
| DE | 42 23 167 A1 | 8/1993 |
| DE | 298 07 082 U1 | 7/1998 |
| DE | 198 50 449 A1 | 5/2000 |
| EP | 0 261 557 A2 | 3/1988 |
| EP | 0 451 379 A1 | 10/1991 |
| EP | 0 815 759 A2 | 1/1998 |
| EP | 0 998 862 A1 | 5/2000 |

* cited by examiner

*Primary Examiner*—M. D. Patterson
(74) *Attorney, Agent, or Firm*—Nixon Peabody LLP; David S. Safran

(57) ABSTRACT

A shoe, especially a sports shoe, has a sole (1) for receiving one or more cleats (5) by means of a molded body (2) which is arranged on the sole at an angle ($\alpha$) of between 15° and 25°, preferably 18°, relative to the plane of the sole (S) and which has an opening (3) for receiving a securing device (4) which is located on the cleat. The cleat also has a recess which is complementary to the cross-section of the molded body. The molded body and the cleat are connected by placing the cleat onto the molded body and activating the securing device, so that the cleat is forcibly guided into the locking position or out into the unlocking position.

15 Claims, 2 Drawing Sheets

SPORTS SHOE

BACKGROUND OF THE INVENTION

1. Field of the Invention

The invention relates to a shoe, especially for purposes of sports, with a sole which has at least one cleat which is detachably connected to the sole via a positive connection and a locking arrangement.

2. Description of Related Art

One such shoe is known from European Patent EP 0 815 759. The shoe has a sole with cleats detachably mounted on it, the cleats being held via positive connection and a locking arrangement on the sole. This positive connection consists, for example, of a polygonal base located on the cleat and a complimentary recess in the sole, while the locking arrangement consists of a screw on the cleats and of a threaded opening in the sole. The positive connection and the locking arrangement are located perpendicular to the running surface of the sole. This arrangement adversely affects handling when changing the cleats, since first the connection between the screw and screw opening must be established in order to then move the hexagon with the complementary recess in the desired position. The user is therefore forced to hold the cleat in position with one hand, while he must turn the screw to the final locked position with the other hand. Another disadvantage consists in that the screw head projects down to the running surface; this leads to increased wear and fouling. Therefore, rapid replacement of the cleat while the shoe is being used is possible only under more difficult conditions.

Another embodiment is disclosed by German Patent DE 198 50 449, in which a preferably oblong cleat is first inserted into the recess of the sole in order to then push the cleat via a screw fitting and a locking hook into a position which extends behind the recess and to lock it. In this approach, since the screw is located almost parallel to the plane of the sole, wear or fouling of the screw during use is largely avoided. However, in this case, handling when replacing a cleat is not simple, since first the cleat must be inserted into the recess; this is only possible with great difficulty when it has been fouled with dirt, and afterwards, the cleat must be moved into the position which extends behind the recess via the screw and locking hook. In particular, cleats made oblong are subject during use to much higher stresses, so that the locking position which extends behind does not always establish a reliable connection. Another disadvantage consists in that this approach has several individual parts which are subject to wear; this makes the execution not only more expensive, but also more susceptible in use.

SUMMARY OF THE INVENTION

Thus, a primary object of this invention is to devise a shoe, especially for purposes of sports, in which not only replacement of the cleat can be done easily and with one hand, but also reliable holding is enabled. Moreover, it is desire to achieve a design which will use few parts and will be compact and robust.

In accordance with the invention, this object is achieved by the sole having a molded body which is located at an angle to the plane of the sole and an opening for accommodating the locking arrangement so that the cleat, upon actuation of the locking arrangement, is forced into the locked position or is moved out into the unlocked position.

It is important for the invention that, by the arrangement of the shaped body of the sole at an angle between 15° and 25°, the cleat can be easily installed, and via a locking arrangement which is made as a screw and which is located at the same angle, automatic insertion of the cleat into the locked position takes place when the screw is turned. Conversely, upon unlocking, automatic removal into the unlocked position is achieved without two hands being necessary. The locking arrangement made as a screw is protected against wear and damage and in spite of a dirty sole, application of the cleat without great effort is possible.

Here, it is especially preferred that the molded body is injection molded either with the sole as an integrated component or as a separate component or cemented into the sole. The preferably form-fitted connection between the cleat and molded body is suitable when the molded body has a T-shaped or round cross section.

Embodiments of the invention are explained in detail below with reference to the accompanying drawings.

DETAILED DESCRIPTION OF THE INVENTION

Figure 1:
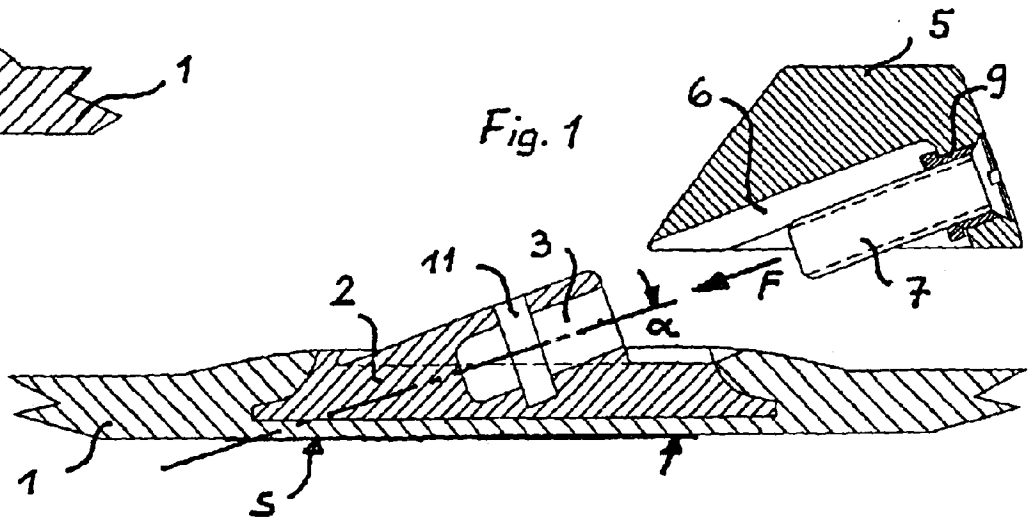
FIG. 1 is a cutaway view of a portion of a sole with the molded body in accordance with the invention and a cleat which has been cut in the lengthwise direction in the unlocked position.

It can be recognized from FIG. 1 that the sole 1 of a shoe, especially for purposes of sports, such as, for example, field sports, has a molded body 2 which can be either an integral component of the sole, or as shown, is injected or cemented into the sole as a separate part. Of course, other joining means between the sole and the molded body are also possible. Although the embodiments only show one molded body, it should be clear that the sole can or will have several molded bodies located anywhere to accommodate the cleats.

However, it is significant for the invention that the molded body 2 is located at an angle $\alpha$ of between 15° and 25° relative to the plane S of the sole. Tests have shown that the best handling is achieved at an angle $\alpha$ of 18°. Here, it is not important whether the molded body 2 projects beyond the plane S of the sole or not. However, the embodiments shown have the advantage that the sole can be produced to be relatively thin, and thus weight-saving, and that a connection can be made very easily between the molded body 2 and the cleat 5.

The molded body 2 of the invention is designed to accommodate the cleat 5, likewise shown in FIG. 1, and to keep it locked, for which there is a locking arrangement 4.

Figure 3:
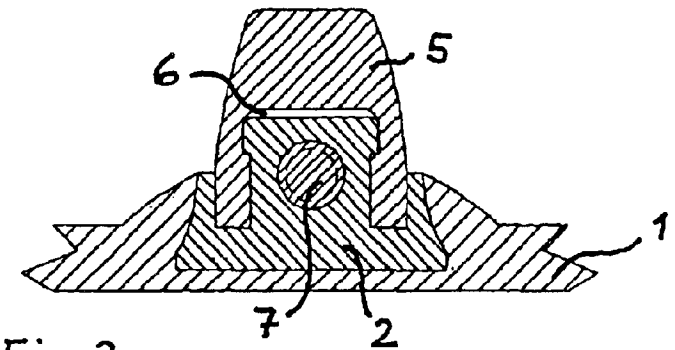
FIG. 3 shows a section taken along line III—III in FIG. 2.

According to the preferred embodiment in FIG. 1, the molded body 2 has a T-shaped cross section with an opening 3 and a nut 11 located in the opening for accommodating the locking arrangement 4, this opening being located at the same angle $\alpha$ as the molded body. In order to be able to positively engage the cleat 5 to the molded body 2, the cleat 5 has a recess 6 complementary to the cross section of the molded body 2, as can be seen especially in the sectional view as shown in FIG. 3. Moreover, on the cleat 5, a threaded screw 7 is attached via a locknut 9.

Figure 2:
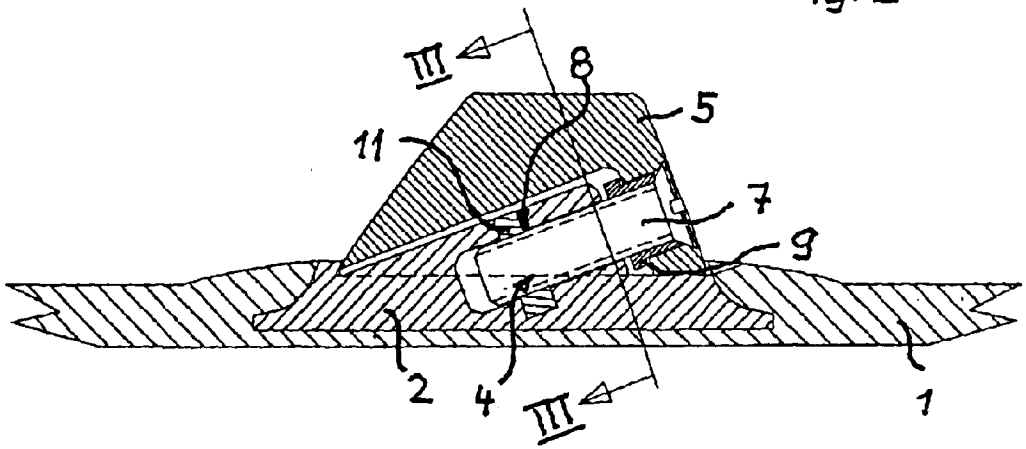
FIG. 2 shows a view according to FIG. 1, but in the locked position.

The connection of the molded body 2 to the cleat 5 takes place in the simplest manner by the cleat being placed onto the molded body in the insertion direction F. By turning the threaded screw 7, the cleat 5 is forced into the locked position as shown in FIG. 2. This special execution of the positive connection between the molded body 2 and the cleat 5 and the locking arrangement 4 adapts the cleat to the sole so that a reliable and compact locking position is achieved.

Unlocking or removal of the cleat 5 from its locked position into its unlocked position takes place in the reverse sequence by the cleat 5 being forced out opposite the insertion direction F by turning the threaded screw 7. As soon as the threaded connection between the threaded screw 7 and the nut 11 has been neutralized, the cleat 7 can be removed from the molded body 2.

FIG. 2 shows the locked position and it is apparent that the cleat 5 has been screwed entirely onto the molded body 2 and the sole 1 via positive locking and the screw fitting and is joined securely and reliably to the sole. It is also enormously advantageous that, if the threaded screw should come loose by itself unexpectedly, nevertheless the connection of the cleat and sole is preserved via the positive locking. Of course, the illustrated nut 11 could also be located nearer in the starting area of the opening 3, or instead of a nut, other known opposite threads could be used.

In the representations as shown in FIGS. 2 and 3, it also becomes clear that relatively high surface pressure is produced by the positive locking; this results in secure holding and good transfer of force. The locking arrangement 4 made as a screw fitting, however, ensures that the cleat 5 is necessarily, and thus easily, inserted and removed in spite of high surface pressure. This is of great importance especially in the case of use for athletic purposes, for example, for field sports, because here fouling with dirt must often be expected.

Figure 4:
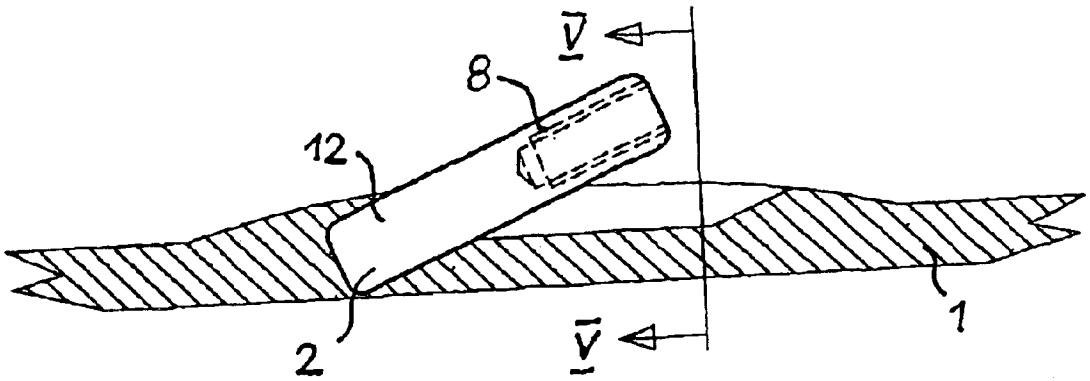
FIG. 4 shows a lengthwise section of another embodiment.
Figure 5:
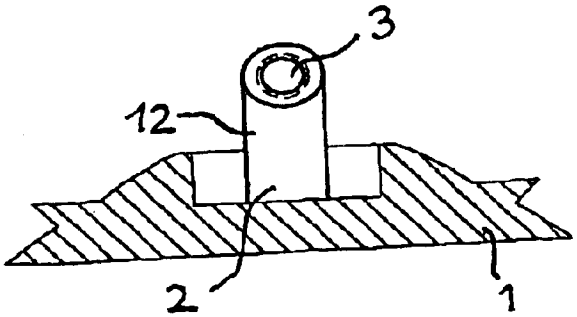
FIG. 5 shows a section taken along line V—V in FIG. 4.

Another version of the invention is shown in FIGS. 4 and 5; it is characterized essentially by its simplicity and thus could also be cheaply produced. The molded body 2 in this case has a round cross section and is formed of a round rod or tube 12 which could also be produced from commercial goods, e.g., tube stock material. This round molded body 2 is connected by suitable fasteners such as, for example, cement, to the sole 1, and likewise projects in accordance with the invention at an angle $\alpha$ between 15° and 25° relative to the plane S of the sole. Insertion of the cleat 5, in this approach, is especially reliable since, according to experience, the positive locking of round, complementary parts proceeds much more easily than for nonround parts. The cleat which is not shown for this version, therefore, likewise, has a recess 6 with a complementary, round cross section and a locking arrangement 4. In the case of the locking arrangement 4 made as a threaded screw 7, the insertion of the cleat 5 could take place in a simple manner. This is because, as soon as the cleat 5 has been placed on the round molded body 2, by turning the threaded screw 7 the cleat is necessarily pushed onto the round rod 12 up to the locked position. The prerequisite for this is also that the round rod has an opening 3 which is made with an opposing thread 8 to the threaded screw 7. One additional component, such as, for example, the nut 11 as shown in FIG. 2, can be eliminated in this case.

Finally, it should be pointed out that the locking arrangement 4 as well as the molded body 2 could have shapes other than those shown without departing from the framework of the invention.

What is claimed is:

1. Shoe with a sole which has at least one cleat which is detachably connected to the sole via a positive connection and a locking arrangement, wherein the sole has a molded body which is located at an angle to a plane of the sole and wherein the molded body has an opening for accommodating the locking arrangement so that the cleat, upon actuation of the locking arrangement, is forced into a locked position or is moved out into an unlocked position; and wherein said angle is between 15° and 25°.

2. Shoe as claimed in claim 1, wherein the molded body is an integrated component of the sole.

3. Shoe as claimed in claim 1, wherein the molded body is a separate part which is cemented or injected into the sole.

4. Shoe as claimed in 1, wherein the molded body has a T-shaped cross section.

5. Shoe as claimed in claim 1, wherein the molded body has a round cross section.

6. Shoe as claimed in claim 1, wherein the cleat has a recess which has a shape which is complementary to the cross section of the molded body.

7. Shoe as claimed in claim 1, wherein the opening for accommodating the locking arrangement is located at the same angle as the molded body.

8. Shoe as claimed in claim 7, wherein the opening has a round cross section.

9. Shoe as claimed in claim 8, wherein the locking arrangement comprises a screw fitting which is composed of a threaded screw which is attached to the cleat, and of an opposing thread which is located on the molded body.

10. Shoe as claimed in claim 9, wherein the threaded screw is supported on a locknut which is joined to the cleat.

11. Shoe as claimed in claim 10, wherein the threaded screw and the locknut are supported on a wall of the cleat which terminates the recess.

12. Shoe as claimed in claim 9, wherein the opposing thread is formed in a nut which is located in the opening of the molded body.

13. Shoe as claimed in claim 9, wherein the opposing thread is provided in the opening of the molded body with a round cross section.

14. Shoe as claimed in claim 1, wherein said angle is 18°.

15. Shoe with a sole which has at least one cleat which is detachably connected to the sole via a positive connection and a locking arrangement, wherein the sole has a molded body which is located at an angle to a plane of the sole and wherein the molded body has an opening for accommodating the locking arrangement so that the cleat, upon actuation of the locking arrangement, is forced into a locked position or is moved out into an unlocked position; and wherein the molded body has a T-shaped cross section.

* * * * *